United States Patent [19]

Luojus

[11] Patent Number: 4,991,493

[45] Date of Patent: Feb. 12, 1991

[54] CYLINDER WITH TWO CONCENTRIC PISTONS ACTUATED BY A PRESSURE MEDIUM AND EXTENDING TO THREE TIMES THE LENGTH OF THE CYLINDER

[76] Inventor: Matti N. Luojus, Äyräpäänkatu 12, 33340 Tampere, Finland

[21] Appl. No.: 303,762

[22] PCT Filed: May 18, 1988

[86] PCT No.: PCT/FI88/00075

§ 371 Date: Jan. 23, 1989

§ 102(e) Date: Jan. 23, 1989

[87] PCT Pub. No.: WO88/09441

PCT Pub. Date: Dec. 1, 1988

[30] Foreign Application Priority Data

May 18, 1987 [FI] Finland ..... 872189

[51] Int. Cl.[5] ..... F01B 7/20

[52] U.S. Cl. ..... 92/53; 92/75; 91/173; 91/189 A

[58] Field of Search ..... 92/75, 51, 53; 91/170 R, 173, 189 A, 189 R

[56] References Cited

U.S. PATENT DOCUMENTS

| | | | |
|---|---|---|---|
| 3,877,349 | 4/1975 | Schindel | 92/53 |
| 3,945,300 | 3/1976 | Bourges | 91/173 |

FOREIGN PATENT DOCUMENTS

| | | | |
|---|---|---|---|
| 46-43323 | 12/1971 | Japan | 92/75 |
| 143285 | 8/1960 | U.S.S.R. | 92/53 |
| 528256 | 9/1976 | U.S.S.R. | 92/75 |

*Primary Examiner*—Edward K. Look
*Assistant Examiner*—John Ryznic
*Attorney, Agent, or Firm*—Darby & Darby

[57] ABSTRACT

The invention concerns a cylinder-piston combination actuated by a pressure medium, comprising an outstretched cylinder space (1) and a two-part piston assembly (3, 8) movable in opposite directions in the longitudinal direction of the cylinder space (1). The piston rod (6) of the first part (3) of the piston assembly is of a tubular construction. The first part (3) is provided with a sealing between the piston (4) and the inner surface (2) of the cylinder space (1). The cylinder space (1) is provided with a connection (27) through which the pressure medium can be passed into the space (31) limited by the cylinder space (1) and the outer surface of the first part (3). The second part (8) is constructed to dimensions allowing it to fit inside the first part (3) and arranged to be movable relative to the latter. The combination includes an auxiliary piston (14) fitted around the piston rod (13) of the second part and sealed relative to the inner surface (2) of the cylinder space (1). The cylinder space is provided with a connection (25) permitting the passage of the pressure medium into the space (29) limited by the cylinder space (1) and the auxiliary piston end face (20) facing away from the first part (3). The cylinder space (1) is provided with another connection (26) permitting the passage of the pressure medium to the auxiliary piston end face (21) facing towards the first part (3) when the piston (9) of the second part (8) is in engagement with the auxiliary piston (14).

9 Claims, 3 Drawing Sheets

CYLINDER WITH TWO CONCENTRIC PISTONS ACTUATED BY A PRESSURE MEDIUM AND EXTENDING TO THREE TIMES THE LENGTH OF THE CYLINDER

FIELD OF THE INVENTION

The present invention relates to a cylinder-piston combination actuated by a pressure medium. The combination has an out-stretched cylinder space and a two-part piston assembly so arranged that it will move in opposite directions in the axial direction of the cylinder space.

BACKGROUND OF THE INVENTION

In previously used solutions in this category, the pistons in the piston assembly are placed inside the cylinder space opposite to each other, with the piston rods protruding from opposite ends of the cylinder, the length of each rod equalling essentially half the length of the cylinder space Thus the maximum length of the combination is essentially twice that of the cylinder space. In many cases, this is not sufficient in view of the required change in the length, especially when the space available imposes restrictions on the maximum length and other dimensions of the cylinder space. Such a situation prevails especially in telescopic boom structures which should be extendable to a sufficient length when working and still be able to contract into a sufficiently compact form when at rest.

SUMMARY OF THE INVENTION

The object of the present invention is to propose a cylinder-piston combination which is extendable to a length essentially three times that of the cylinder space. None of the external dimensions of the combination differs substantially from the corresponding dimension of a conventional dual-piston cylinder. The combination has a simple structure and its control functions are easy to implement using normal control techniques.

The chief characteristics of the invention are as exposed in claim 1. Certain preferred embodiments are presented in the subclaims.

BRIEF DESCRIPTION OF THE DRAWINGS

In the following, the invention is described with reference to the drawings attached.

DETAILED DESCRIPTION OF THE PREFERRED EMBODIMENTS

Figure 1:
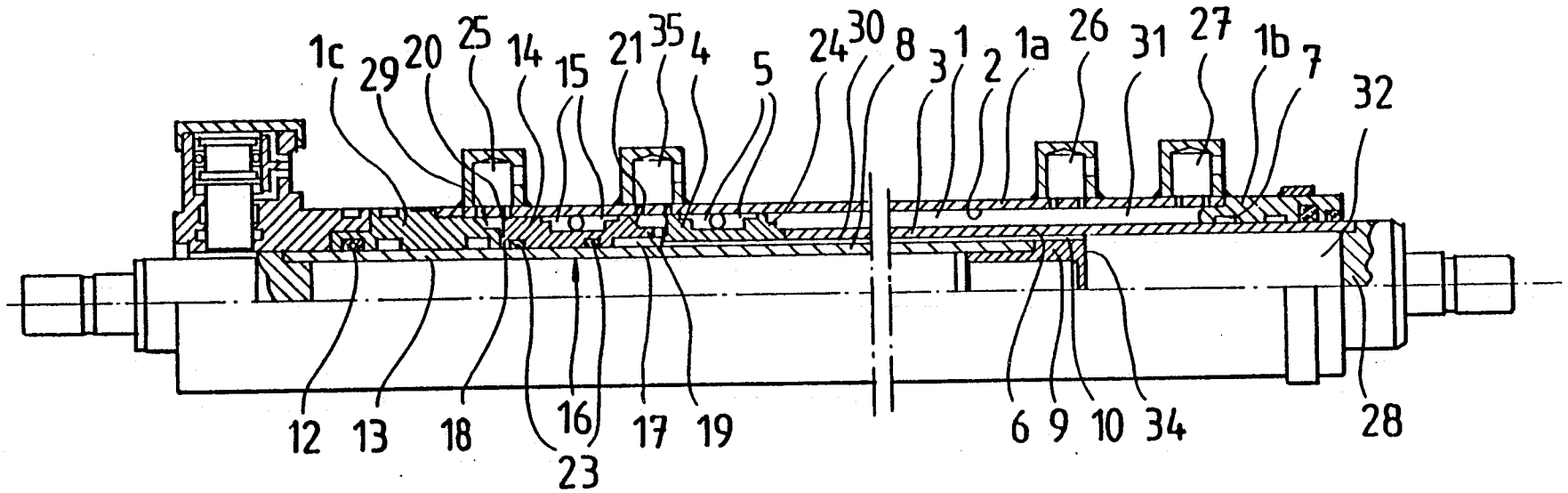
FIGS. 1–3 are longitudinal sectional views of one of the possible implementations in different phases.

FIG. 1 represents the cylinder-piston combination with the piston rods inside the cylinder, the combination being contracted to its minimum length The cylinder space 1 is constituted by a jacket tube 1*a*, preferably of a round sectional form. The first part 3 of the piston assembly—via the mediation of the outer piston 4 belonging to it—is in contact with the inside surface 2 of the jacket tube. The outer piston 4 is provided with sealings 5 between the piston and the inside surface 2. When the combination opens, the piston rod 6 of the first part 3 in FIG. 1 moves right and is pushed against the seal 7 belonging to the right-hand end flange 1*b* of the cylinder space 1. The piston rod 6 is of a tubular construction and its inner diameter corresponds to the diameter of the inner piston 9 belonging to the second part 8 of the piston assembly. In the closed position of the combination, the second part 8 is substantially inside the first part 3. The outer surface of the inner piston 9 is provided with several axial grooves 10. When the combination opens, the piston rod 13 of the second part 8 in FIG. 1 moves left and is pushed against the sealing 12 belonging to the left-hand end flange 1*c* of the cylinder space 1. The piston rod 13 may be either tubular, as in the present example, or a solid rod.

The combination also comprises an auxiliary piston 14, with sealings 15 between the piston and the inside surface 2 of the cylinder space 1. The auxiliary piston 14 is provided with a central opening 16 to allow the piston rod 13 of the second part 8 to move relative to the auxiliary piston 14. In addition, the auxiliary piston has a cut-out 17 whose dimensions essentially correspond to those of the inner piston 9, and one or more projections 18 and 19 or equivalent, preferably located on the end faces 20 and 21. The auxiliary piston 14 is also provided with a sealing 23 to seal the gap between itself and the piston rod 13. At the point of connection between the outer piston 4 and the piston rod 6 is a shoulder 24.

The jacket tube 1*a* of the cylinder space 1 is provided with three connections 25, 26, 27 through which the pressure medium is passed into the cylinder space 1 to control the operation of the combination.

Figure 2:
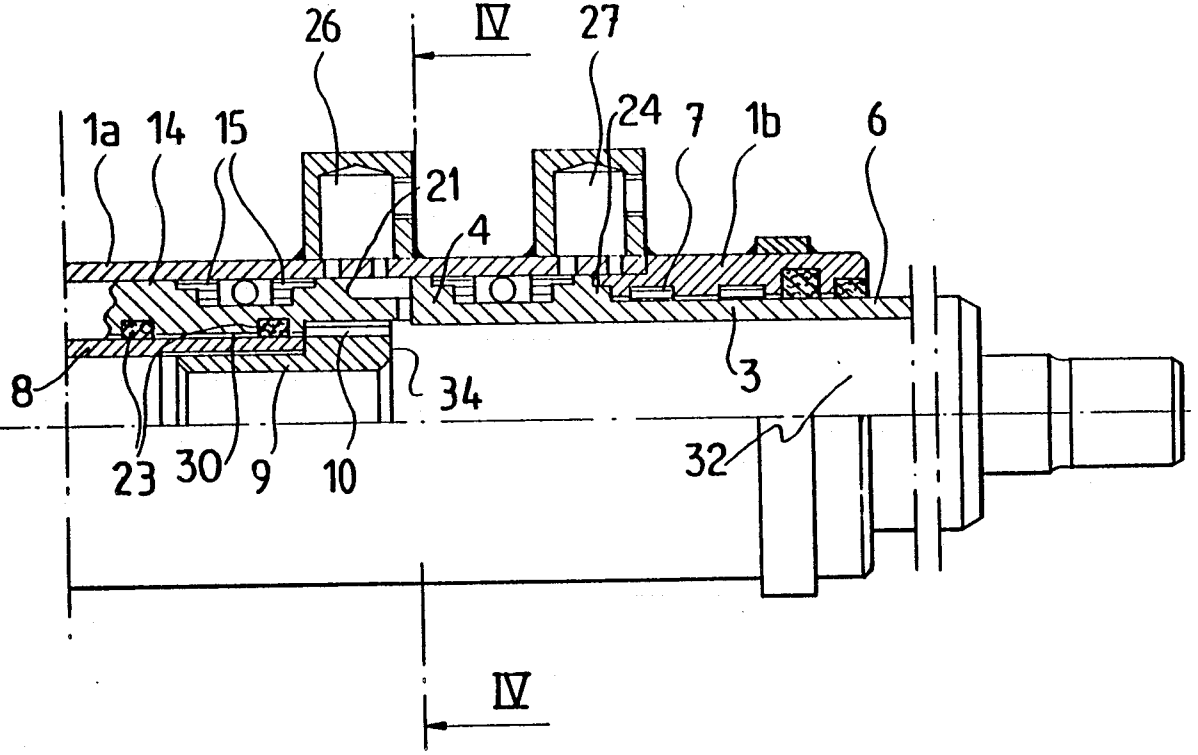

Through the first connection 25, a pressure is applied to the left-hand end face 20 of the auxiliary piston, i.e. the medium is passed into the space 29 formed between the end flange 1*c* and the auxiliary piston 14 by means of the projection 18 when the combination is in the closed position as shown in FIG. 1. Through the second connection 26, with outer piston 4 positioned to the right as shown in FIG. 2, a pressure is applied to the portion 30 of the cylinder space limited by the inside surface of the outer piston 4, the end face 21 of the auxiliary piston 14 and the outer surface of the second part 8. Through the third connection 27, a pressure is applied to the cylinder space portion 31 limited by the outer surface of the first part 3. The space 32 between the end 28 of the piston rod 6 and the inner piston 9 also plays a role in the transfer of the pressure medium. The connections for the pressure medium are so located that, during a cycle of operation of the combination, each is active in turn.

Figure 4:
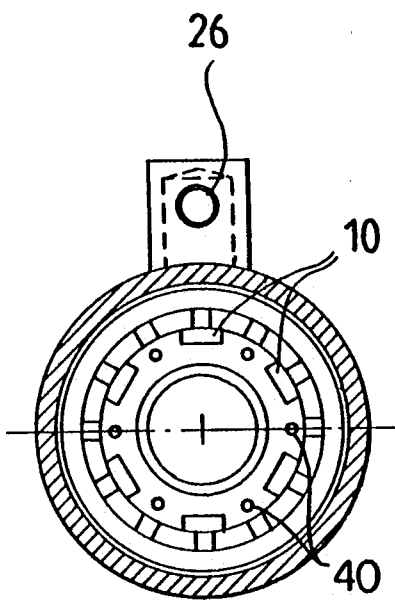

Referring to the drawings, the combination works as follows:

When the pressure medium is allowed to flow from the first connection 25 into the space 29, the combination will move from the closed position shown in FIG. 1, in which the inner piston is inside the piston rod 6 at the right-hand end of the cylinder space and the outer piston 4 as well as the auxiliary piston are at the left-hand end of the cylinder space at a distance determined by the shoulder 19 from each other, into the position shown in FIG. 2. The auxiliary piston 14 pushes the first part 3 to the right-hand end of the cylinder space, so that the piston rod 6 moves out of the cylinder space 1 until the shoulder 24 is pressed against the end flange 1*b* and the space 31 is at a minimum. During this movement, the connection 27, and possibly connection 26 as well, is open to permit the pressure medium to flow out of the space 31 The space 30 is also reduced during this movement and the pressure medium in it flows through holes 10 into the space 32. Holes 40 penetrating in the axial direction of piston 9 can be provided. At the end of the movement, the inner piston 9 is in the cut-out 17 in the auxiliary piston 14 as shown in FIG. 2, so that the spaces 30 and 32 shown in FIG. 2 merge and the connection 26 is to the right of the auxiliary piston end face 21 and can therefore communicate with the spaces 30 and 32. FIG. 4 shows a section IV—IV through the combination. The connection 27 communicates with the space 31.

Figure 3:
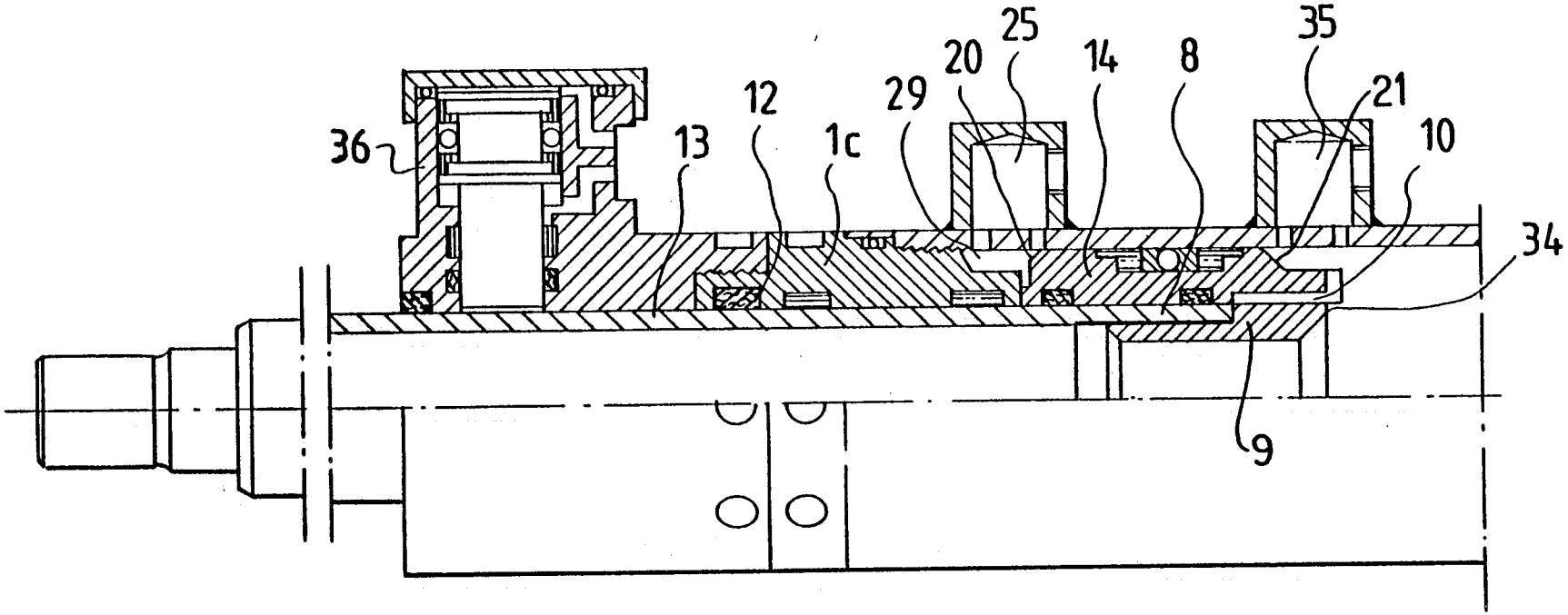

When the pressure medium is allowed to flow via the connection 26 into the spaces 30 and 32, the combination of the inner piston 9 and the auxiliary piston 14 moves left to the position shown in FIG. 3 as the pressure acts on the end face 21,34 formed by the two pistons together, and the piston rod 13 moves simultaneously to its outermost position on the left. During this movement, the connection 25 has to be open to allow the pressure medium in the diminishing space 29 to flow out. The combination is now extended to its maximum length, essentially three times the length of the cylinder space. With the aid of the auxiliary piston 14, the piston rods 6 and 13 have been successively forced out from the cylinder space.

When the combination is to be brought again into the position shown in FIG. 1, the pressure medium is first allowed to flow from the connection 25 into the space 29 while the connection 27 is kept open. As a result, the combination moves into the position shown in FIG. 2. Next, the pressure medium is caused to flow via connection 27 into the space 31 while connection 25 is kept open and connection 26 closed, resulting in the situation shown in FIG. 1. Now, with the inner piston 9 remaining in place, separate spaces 30 and 32 are restored. This function can be implemented by providing the cylinder jacket 1*a* with an additional connection 35 located to the right of the end face 21 when the auxiliary piston is in its extreme position on the left (FIG. 1). Thus the portion of the pressure medium which is stored between the auxiliary piston 14 and the first part 3 and which increases the distance between them during the right-to-left movement, the volume of said portion corresponding to the capacity of the piston rod 3, is exhausted via the additional connection 35 when the auxiliary piston 14 reaches its left-hand extreme position, allowing the additional connection 35 to communicate with the space 30. The system also comprises a pressure cylinder 36 actuated by the pressure medium, enabling the piston rod 13 to be locked in its inner position when the piston rod 6 is brought to its inner position.

Obviously the invention can be implemented in other ways besides those described above. It is possible that the cut-out 17 in the auxiliary piston 14 is unnecessary in some embodiments. The shoulder arrangements used to achieve the minima of the pressure spaces may be implemented in different ways. The pressure medium is preferably hydraulic oil. Clearly it is possible to implement the closing of the combination in the reverse order compared to that described in the example. The order described is especially suited for applications employing the telescopic extension principle. The control of the operation of the connections can be implemented e.g. using magnetic valves in the lines connected to them.

I claim:

1. Cylinder-piston combination actuated by a pressure medium, comprising an outstretched cylinder space (1) and a two-part piston assembly (3, 8) movable in opposite directions in the axial direction of the cylinder space (1), the piston rod (6) of the first part (3) of the piston assembly having a tubular construction, the first part (3) being provided with a sealing between the piston (4) and the inner surface (2) of the cylinder space (1), the cylinder space (1) being provided with a connection (27) through which the pressure medium can be passed into the space (31) limited by the cylinder space (1) and the outer surface of the first part (3), the second part (8) being constructed to dimensions allowing it to fit inside the first part (3) and arranged to be movable relative to the latter, characterized in that the combination comprises an auxiliary piston (14) fitted around the piston rod (13) of the second part and sealed relative to the inner surface (2) of the cylinder space (1), that the cylinder space is provided with a connection (25) permitting the passage of the pressure medium into the space (29) limited by he cylinder space (1) and the auxiliary piston end face (20) facing away from the first part (3), and that the cylinder space (1) is provided with another connection (26) permitting the passage of the pressure medium to the auxiliary piston end face (21) facing towards the first part (3) when the piston (9) of the second part (8) is in engagement with the auxiliary piston (14).

2. Combination according to claim 1, characterized in that the first part (3) is provided with a shoulder (24).

3. Combination according to claim 1, characterized in that the piston rod (6) of the first part (3) has a solid end (28), so that a space (32) for the pressure medium is formed between the inside of the piston rod (6) and the piston (9) of the second part (8).

4. Combination according to claim 1 or 3, wherein the piston (a) is provided with at least one hole penetrating it in the axial direction.

5. Combination according to claim 1, characterized in that the auxiliary piston is provided with a cut-out for the piston (9).

6. Combination according to claim 1, characterized in that the auxiliary piston (14) is provided with distance pieces (18, 19) preferably projecting from its end faces (20, 21).

7. Combination according to claim 1, characterized in that the cylinder space (1) is provided with an additional connection (35) which, relative to the auxiliary piston (14), is located opposite to the space (29).

8. Combination according to claims 1 or 3 wherein the piston (9) is provided with at least one groove 10 on its outer shell.

9. Combination according to claim 4 wherein the piston (9) is provided with at least one groove on its outer shell.

* * * * *